United States Patent [19]

Briner et al.

[11] Patent Number: 4,856,269

[45] Date of Patent: Aug. 15, 1989

[54] DEVICE FOR STARTING OR RECOMMENCING SPINNING OF A YARN IN A FRICTION SPINNING APPARATUS

[75] Inventors: Emil Briner, Winterthur; Samuel Wehrli, Pfäffikon, both of Switzerland

[73] Assignee: Maschinenfabrik Rieter AG, Winterthur, Switzerland

[21] Appl. No.: 186,114

[22] Filed: Apr. 25, 1988

[30] Foreign Application Priority Data

Apr. 29, 1987 [CH] Switzerland ..... 1695/87

[51] Int. Cl.[4] ..... D01H 15/02

[52] U.S. Cl. ..... 57/263; 57/261; 57/401

[58] Field of Search ..... 57/261–263, 57/328, 401

[56] References Cited

U.S. PATENT DOCUMENTS

| | | | |
|---|---|---|---|
| 4,509,322 | 4/1985 | Briner et al. | 57/328 X |
| 4,646,513 | 3/1987 | Briner et al. | 57/263 |
| 4,674,274 | 6/1987 | Katz | 57/328 |
| 4,680,924 | 7/1987 | Briner et al. | 57/263 |

FOREIGN PATENT DOCUMENTS

| | | |
|---|---|---|
| 0175862 | 4/1986 | European Pat. Off. . |
| 0205962 | 12/1986 | European Pat. Off. . |
| 0222101 | 5/1987 | European Pat. Off. . |
| 331868 | 11/1984 | Fed. Rep. of Germany . |

*Primary Examiner*—John Petrakes

*Attorney, Agent, or Firm*—Werner W. Kleeman

[57] ABSTRACT

In order to start or recommence spinning of a yarn in a friction spinning apparatus, in the course of starting of spinning or piecing after a yarn break, by means of a fiber transport duct, fibers separated by an opening device, are delivered to a rotating friction spinning drum and twisted to form a twisted fiber structure. When the twisted fiber structure has reached a substantially predetermined diameter, the twisted fiber structure is moved by an airstream delivered from a pressure air infeed channel towards and into a guide tube and from that location, into the convergent space of rotating withdrawal rolls. The twisted fiber structure is entrained at production speed by these withdrawal rolls and is delivered to the diverging or outlet side of the withdrawal rolls to a suction device placed in readiness. This suction device can transfer the formed yarn following the twisted fiber structure to the succeeding or downstream elements provided for further processing.

18 Claims, 6 Drawing Sheets

6b
24

4
26
12
6
15a; 15.1a 6b
24

4
27
12
6
15b; 15.1b

6b
E
24.1

35
4
B
C
12
6
33
15c; 15.1c

DEVICE FOR STARTING OR RECOMMENCING SPINNING OF A YARN IN A FRICTION SPINNING APPARATUS

CROSS-REFERENCE TO RELATED PATENTS

This application is related to the commonly assigned, U.S. Pat. No 4,646,513, granted Mar. 3, 1987, entitled "METHOD FOR PIECING A YARN IN A FRICTION SPINNING DEVICE" and the commonly assigned, U.S. Pat. No. 4,680,924, granted July 21, 1987, entitled "METHOD OF STARTING SPINNING OF A YARN IN A FRICTION SPINNING DEVICE".

This application is also related to our commonly assigned, co-pending U.S. application Ser. No. 07/203,061, filed June 6, 1988, and entitled "METHOD OF, AND DEVICE FOR, PERFORMING A START SPINNING OPERATION FOR SPINNING OF A YARN IN A FRICTION SPINNING APPARATUS", to which reference may be readily had.

BACKGROUND OF THE INVENTION

The present invention broadly relates to a new and improved construction of a device for performing a start spinning operation, namely, starting or recommencing spinning of a yarn or the like in a friction spinning apparatus.

In its more particular aspects, the device for starting or recommencing spinning of a yarn in a friction spinning apparatus comprises friction spinning means containing a friction spinning surface provided thereon to which fibers are delivered. The fibers are formed into a twisted fiber structure or lap at a yarn formation position of the friction spinning means during the starting or recommencing of the spinning operation. The twisted fiber structure is withdrawn by a yarn withdrawal means, typically, a yarn withdrawal roller pair.

Previously known devices for the above-mentioned start spinning of a yarn, employ a yarn end withdrawn from a package. This yarn end is inserted into the stationary friction spinning means for start spinning and thereafter the start spinning operation is carried out at reduced speed of the friction spinning apparatus by feeding fibers to the yarn end withdrawn from the package. It has also been proposed that prior to start spinning, that is, before feed of freely floating fibers to the returned yarn end, the latter should be untwisted by movement of the friction spinning means in an opposite direction to enable better connection or interlacing of the delivered fibers with the yarn end.

Such a device is known from German Published Patent Application No. 3,318,687, in which a yarn end from a reverse rotated package is taken-up by a suction device and the yarn drawn-in by suction is held by means of two reciprocating devices in the convergent zone of two stationary friction spinning drums.

Before delivery of freely floating fibers to this yarn, the yarn is opened by reverse rotation of the friction spinning drums so that the fibers lie in a substantially twist-free condition in the convergent zone of the friction spinning drums. Thereafter, the friction spinning drums are placed into operation with reduced rotational speed in the normal direction of rotation and freely floating fibers are delivered to the opened yarn. The yarn which is thus produced, is withdrawn at a correspondingly reduced speed and delivered to a joining or connection means.

In order to take-up the continuously delivered yarn operation, the delivered yarn is received by a suction nozzle functioning as a yarn store or storage.

After completion of the joining or connection operation, the complete device is accelerated to the operating speed and thereafter is disconnected from the necessary auxiliary drive means and is driven by the normal drive means at the operating speed.

Certain of the disadvantages of a device of this type reside in the large amount of auxiliary equipment needed for the start spinning operation.

In the aforementioned U.S. Pat. No. 4,680,924, there is disclosed a method of start spinning of a yarn in a friction spinning device. Freely floating fibers are forwarded to a yarn formation position where such freely floating fibers are formed into a twisted fiber structure of a certain size. An airstream is used to forward the twisted fiber structure towards yarn withdrawal rolls. A shortcoming of such arrangement is that it is difficult to dose the airstream such that the twisted fiber structure is not entrained by the air which flows off in axial direction of the yarn withdrawal rolls. Should that happen, then there can arise the undesired situation that the twisted fiber structure is not engaged by the yarn withdrawal rolls.

SUMMARY OF THE INVENTION

Therefore, with the foregoing in mind, it is a primary object of the present invention to provide a new and improved construction of a device for start spinning, namely, starting or recommencing spinning of a yarn in a friction spinning apparatus which is not afflicted with the aforementioned drawbacks and limitations of the prior art constructions.

Another and more specific object of the present invention relates to a new and improved construction of a device for starting or recommencing spinning of a yarn in a friction spinning apparatus which is uncomplicated in its construction and operation and can be designed to work with relatively simple means.

Yet a further significant object of the present invention is directed to a new and improved construction of a device for starting or recommencing spinning of a yarn in a friction spinning apparatus and containing structure for the controlled infeed of an airstream in a prescribed manner such that there is reliably directed, the twisted fiber structure towards and into engagement with a yarn withdrawal facility, such as yarn withdrawal rolls.

A further significant object of the present starting or recommencing spinning of a yarn in a friction spinning apparatus, wherein such starting or recommencing operation can be accomplished with great reliability and through the use of relatively simple structural components so that such device is not only simple in design and relatively inexpensive to fabricate, but requires a minimum of maintenance and servicing.

Now in order to implement these and still further objects of the invention, which will become more readily apparent as the description proceeds, the device for starting or recommencing spinning is manifested, among other things, by the features that the device for start spinning comprises a pressure air infeed channel, the air outflow opening of which is directed towards the yarn formation position and the flow direction of which is directed such that the dynamic or back pressure arising from the airflow or airstream is divided into two force components of different magnitudes, wherein the larger force component acts in the withdrawal direction of the yarn. Furthermore, there is provided, a yarn guide element between the friction spinning means and the yarn withdrawal roller pair by means of which there is guided the twisted fiber structure and a portion of the air flow or airstream of the pressure air infeed channel.

Certain of the more notable advantages afforded by the present invention reside in the fact that the device for starting or recommencing spinning of the yarn or the like in the friction spinning apparatus is relatively simple by virtue of the fact that there is afforded the possibility of performing the starting of, or recommencing of, the spinning operation at production speed.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the device for starting or recommencing of spinning as well as the related friction spinning apparatus has been illustrated therein as is needed to enable one skilled in the art to readily understand the underlying principles and concepts of the present invention. It is here further remarked that the term "start spinning" or equivalent expressions as employed hereinafter, mean either the starting of spinning or piecing after a yarn break in order to recommence spinning.

Figure 1:
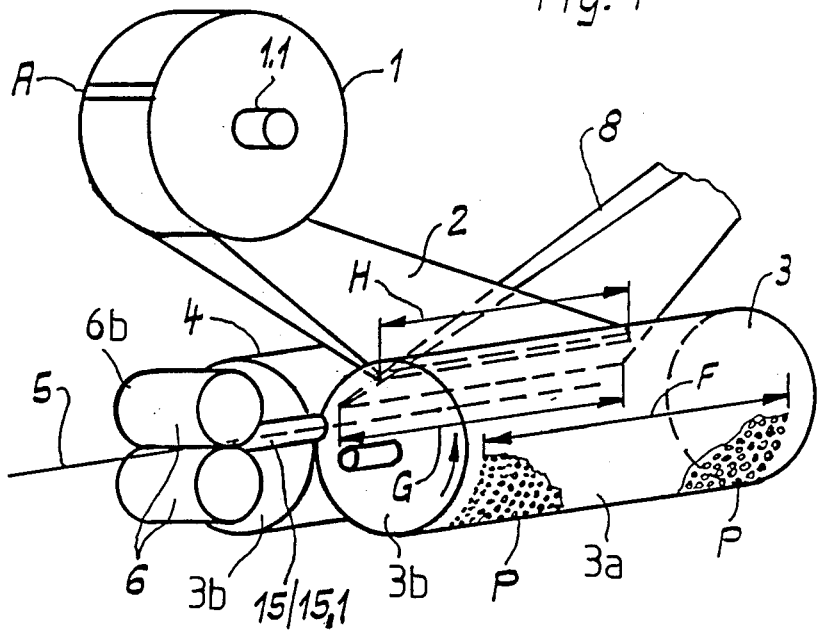
FIG. 1 illustrates the general construction of a friction spinning apparatus depicted part schematically and in perspective view and substantially corresponding to the friction spinning apparatus described in cross-referenced U.S. Pat. No. 4,680,924.
Figure 2:
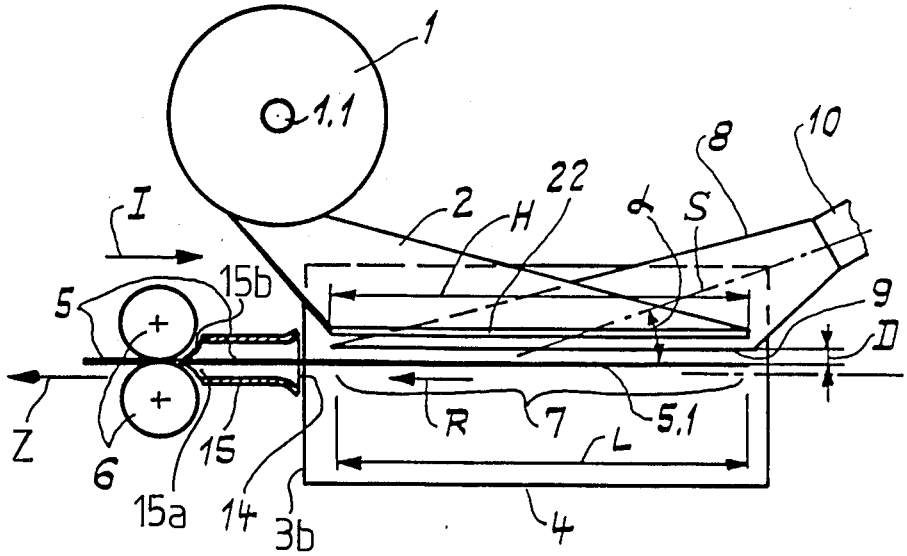
FIG. 2 illustrates part of the friction spinning apparatus of FIG. 1 in longitudinal direction.

Turning attention now specifically to FIG. 1 of the drawings, the general construction of the friction spinning apparatus illustrated therein by way of example and not limitation, will be seen to comprise substantially like the friction spinning apparatus described in the initially cross-referenced U.S. Pat. No. 4,680,924, a fiber sliver opening device 1 known from the rotor open-end spinning technique or art, which contains a conventional opening roller (not shown) and which therefore has been merely generally indicated or represented by its drive shaft 1.1. This fiber sliver opening device 1 contains an infeed opening A for receiving a fiber sliver (not shown) or other suitable fiber material. By means of a fiber infeed or transport duct or passage 2 adjoining the fiber sliver opening device 1, freely floating fibers are delivered to a rotatable and driveable perforated friction spinning drum or roll 3 by means of an airstream or airflow which flows through the fiber infeed duct or passage 2. As shown in FIG. 2, a yarn end 5.1 is formed at a yarn formation position or location 7 on the friction spinning drum 3 and from which there is ultimately produced, a yarn 5 or the like.

A counter roll or drum 4 which is also rotatable and driveable is arranged without contacting but in very close disposition with respect to the friction spinning drum or roll 3 and substantially parallel thereto (for example, with a pacing between 0.05 and 0.15 mm). The counter roll or drum 4 serves as an aid for twisting-in the fibers at the yarn formation position or location 7 located in the convergent zone or nip of the two drums or rolls 3 and 4. The spun yarn 5 is withdrawn by yarn withdrawal means, here shown in the form of a withdrawal roller or roll pair 6. Such structure is known from earlier publications in this technology and constitutes state-of-the-art arrangements for friction spinning equipment, and thus, will not further be described herein. For example, the commonly assigned European Published Patent Application No. 0,175,862, published Apr. 2, 1986, shows a basically similar technique and thus reference may be readily had to such document, the disclosure of which is incorporated hereinafter.

Furthermore, in addition to the fiber infeed or transport duct or passage 2, a pressure air infeed channel or duct 8 opens over the yarn formation position or location 7 in the convergent region of the two friction spinning drums 3 and 4 (also referred to in the art as friction spinning rolls 3 and 4). The length G of the exit or outlet opening 9 of the pressure air infeed channel 8 corresponds at least to the length F (FIG. 1) of the perforated region P of the perforated friction spinning drum 3, while the length H of the exit or outlet opening 22 of the fiber infeed duct or passage 2 corresponds at most to the length F of the perforated region. This perforated region P is illustrated only partially in FIG. 1 for simplicity of drawing representation.

The relation of the distance D or D.1 (FIG. 3 or 3*a*) between the exit or outlet opening 9 of the pressure air infeed channel 8 and the yarn end 5.1 located in the yarn formation position or location 7 to the intensity or energy of the air jet at the exit or outlet opening 9 of the pressure air infeed channel 8 must be determined empirically on the basis of the subsequently described method or operational steps for the start spinning operation.

The same applies for the not particularly referenced width or breadth and form of the exit or outlet opening 9 of the pressure air infeed channel 8, the term "form" referring to the configuration or formation of the exit opening surface, to enable variability of the intensity of the airstream or air flow at such exit or outlet opening 9. By way of example, the width or breadth of the exit or outlet opening 9 can be varied along the length of such exit or outlet opening 9 in order to obtain differences in the air blowing effect or action along the exit or outlet opening 9.

As shown in FIG. 2, the pressure air infeed channel 8 also has a connecting stud or connection 10 by means of which the pressure air infeed channel 8 is connectable to a suitable and thus here non-illustrated pressure air network or source comprising conventional elements or structure for regulating the air pressure and the air quantity and for the control of the airstream or air flow.

Figure 3:
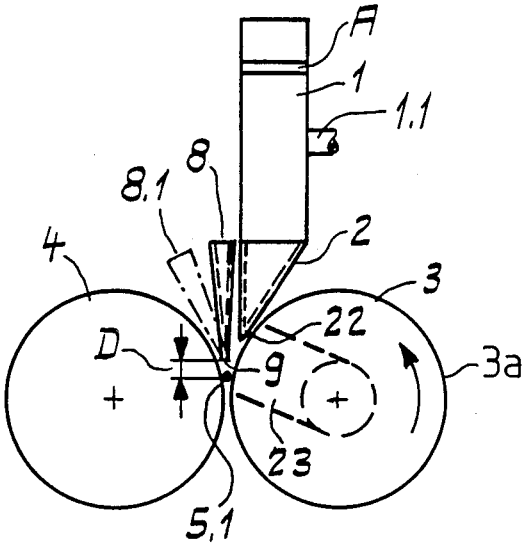
FIG. 3 shows part of the friction spinning apparatus depicted in FIG. 1 and illustrated in front view, looking in the direction of the arrow I of FIG. 2.
Figure 3A:
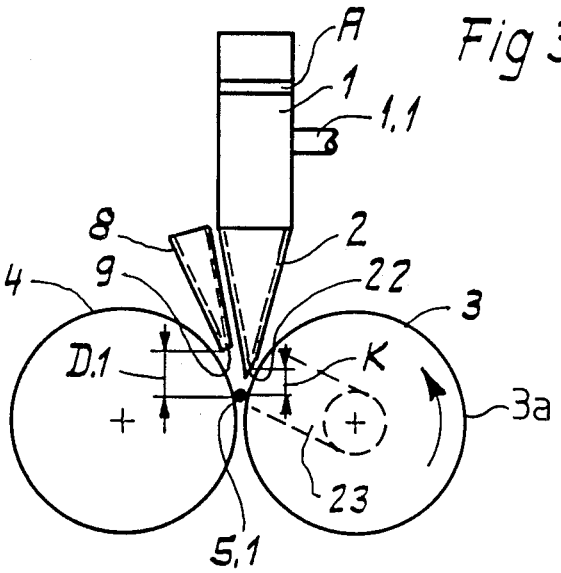
FIG. 3*a* illustrates a modification of the friction spinning apparatus of FIG. 1 but in a showing as depicted in FIG. 3.

FIG. 3*a* shows a modification of the arrangement of FIGS. 1 to 3*a*, wherein it is noted that by altering the distance or spacing D.1, the exit or outlet opening 9 of the pressure air infeed channel 8 can be spaced further from the yarn end 5.1 than the exit or outlet opening 22 of the fiber infeed duct or passage 2 which is shown spaced by the distance K from such yarn end 5.1.

Furthermore, in FIG. 3, the modified positioning of the pressure air infeed channel 8.1 indicated with dash-dotted lines, demonstrates that the position of the pressure air infeed channel is not limited to the position of the pressure air infeed channel 8 illustrated in full lines, and such modification does not involve any substantial reduction in the subsequently described blowing effect or action.

In the following description, there will be considered the procedure for start spinning at the time of a fresh spinning operation, in other words, the start of the thread break, in other words, recommencement of the spinning operation.

First, it should be mentioned that the airstream or air flow previously described and which prevails in the fiber infeed duct or passage 2 for forwarding the fibers 11 from the (non-illustrated) opening roll forming part of the opening device 1 to the friction spinning drum 3 is generated in known manner by a suction nozzle 23 (FIGS. 3 and 3*a*) or equivalent suction facility located in the friction spinning drum 3. This suction nozzle 23 generates at the surface 3*a* of the friction spinning drum 3 over the length F of the perforated region P, a suction airstream or air flow within which there is located, the yarn end 5.1 and the exit or outlet opening 22 of the fiber infeed duct or passage 2.

Figure 5:
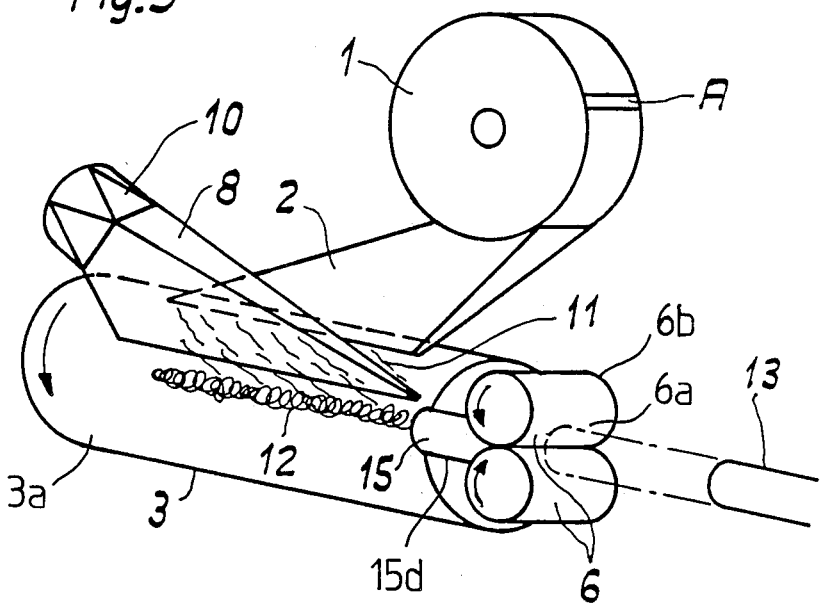
FIG. 5 illustrates the friction spinning apparatus depicted in FIG. 1, showing only a portion thereof and illustrated from the opposite side, portraying one of the operating or method stages of the start (starting or recommencing of the) spinning operation.

As particularly well shown in FIG. 5, during start spinning, the fibers 11 are first fed by means of the fiber infeed duct or passage 2 onto the surface 3*a* of the friction spinning drum 3 without at first withdrawing these fibers as a yarn. Accordingly, there is built-up, a rotating twisted fiber structure or rotating fiber lap 12 of steadily increasing size.

In FIG. 5, the counter roll or drum 4 has not been illustrated in order to facilitate the representation of the twisted fiber structure 12.

Now, when this twisted fiber structure 12 reaches a predeterminate size, a suction device 13 serving as a yarn take-up means or facility is positioned at the diverging or outlet side 6*a* of the yarn withdrawal roller pair 6 which rotate in the direction of the arrows illustrated in FIG. 5 in such a manner that the yarn take-up means or suction device 13 is able to take-up the twisted fiber structure 12 delivered by the yarn withdrawal roller pair 6.

In addition, after the twisted fiber structure 12 has reached the previously mentioned preset size, pressure air is delivered through the pressure air infeed channel 8, so that the twisted fiber structure 12 is reliably and positively passed into the infeed opening 14 (see, for instance, FIG. 2) of a guide tube or tube member 15 and through this guide tube 15 into the converging space of the rotating yarn withdrawal roller pair 6.

As seen in FIGS. 1 and 2, the guide tube or tube member 15 is provided between the end faces 3*b* of the friction drums or rolls 3 and 4 and the yarn withdrawal rollers or roller pair 6 in such a manner that the not particularly referenced axis of symmetry of the guide tube or tube member 15 lies substantially in an imaginary plane which contains the line of contact of the two yarn withdrawal rollers or roller pair 6 and the position or location on the friction spinning therefrom formed spun yarn 5 leave this friction spinning drum 3.

The inner or internal diameter of the guide tube 15 is larger than the external diameter of the previously mentioned twisted fiber structure 12, for example, it may be twice as large.

The exit opening 15*a* of the guide tube or tube member 15 can be, as shown in FIG. 2, provided with cut-away portions 15*b* such that this exit opening 15*a* is adapted to the peripheral surface or curvature of the yarn withdrawal rollers or roller pair 6.

Figure 4:
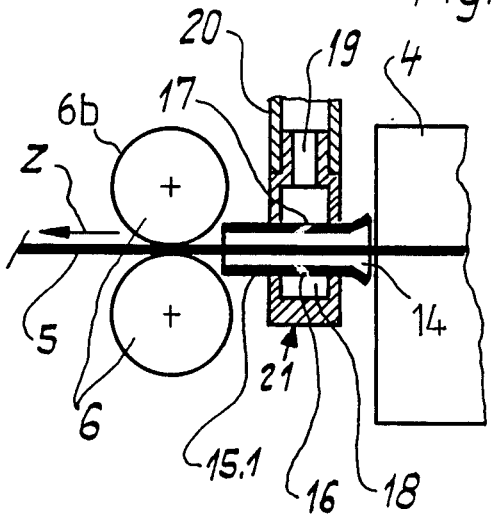
FIG. 4 illustrates in section a modification of part of the friction spinning apparatus of FIG. 1.

Furthermore, as illustrated in FIG. 4, the guide tube or tube member, there designated by reference numeral 15.1, can be designed to form an injector guide passage or guide tube. In this case, pressure air openings or ports 16 and 17 are provided at the wall of the guide tube or tube member 15.1 which impart to an airstream or air flow guided or flowing through these pressure air openings or ports 16 and 17, a force component acting in the yarn withdrawal direction Z.

The aforesaid airstream or air flow is generated by an annular or ring-shaped pressure chamber 18 provided around these pressure air openings or ports 16 and 17 defining blowing openings and which is subjected to above-atmospheric pressure. The annular or ring-shaped pressure chamber 18 is fed by a connecting bore or channel 19 from a non-illustrated pressure air system or source. A connecting or connection tube 20 is fixedly connected with a pressure housing or housing member 21 containing the pressure chamber 18 and the connecting bore or channel 19.

The pressure housing 21, in turn, serves for fixedly receiving the injector guide tube or passage 15.1 and it seals the pressure chamber 18 against the atmosphere.

The injector guide tube or passage 15.1 (FIG. 4) therefore has, in relation to the guide tube or passage 15 (see FIG. 2), the advantage of transporting the previously mentioned twisted fiber structure 12 positively into the converging zone of the yarn withdrawal rollers or roller pair 6 during the start spinning operation.

Figure 6:
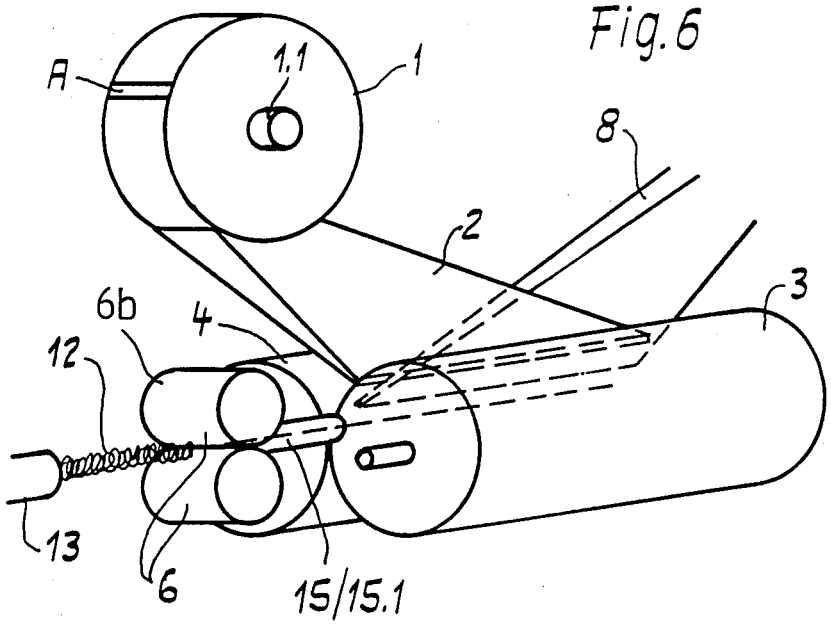
FIGS. 6 and 7 illustrate the friction spinning apparatus depicted in FIG. 1, in various operating or method stages of the start (starting or recommencing of the) spinning operation, FIGS. 8 to 11 respectively illustrate exemplary embodiments of the inventive construction of the friction spinning apparatus depicted in FIG. 1 in a view similar to the showing of FIG. 2.
Figure 7:
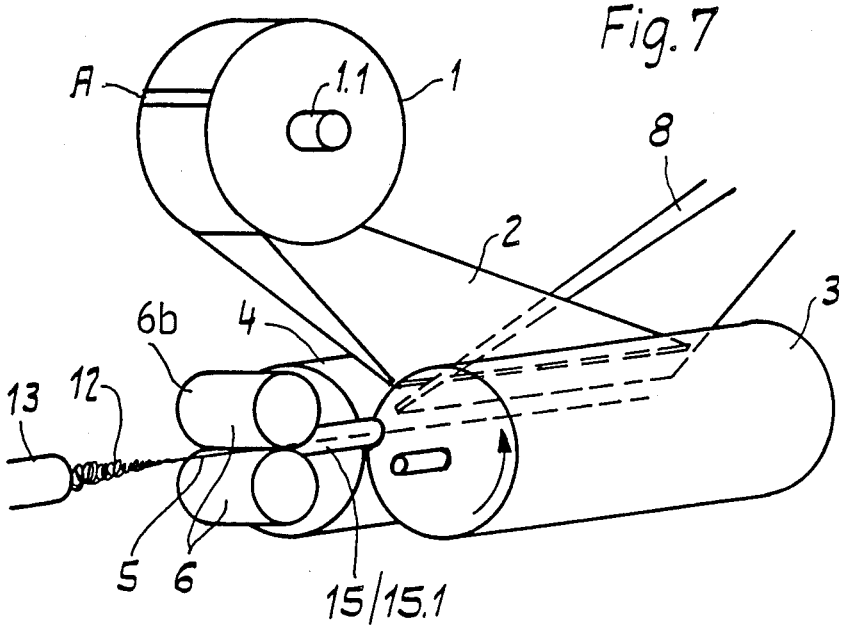

After leaving the yarn withdrawal rollers or roller pair 6, the twisted fiber structure 12 is caught and drawn-in by suction by the suction device 13, as illustrated in FIGS. 6 and 7.

The yarn 5 (see FIG. 7), which is subsequently also drawn-in by suction, is guided by means of this suction device 13 to the further elements forming part of the spinning machine (not shown), and since these further elements are conventional, they need not be here further described.

As soon as the twisted fiber structure 12 has been caught or entrained by the suction device 13, the airstream or air flow in the pressure air infeed channel 8 and the airstream or air flow in the injector guide tube or tube member 15.1, are interrupted.

The previously mentioned start spinning operation can be carried out at full production speed so that the yarn delivered by the yarn withdrawal rollers or roller pair 6 corresponds to the yarn which is to be produced in practice.

It will be clear that the described operation also can be carried out with friction spinning apparatuses having a friction spinning disk in place of the friction spinning drums and using as the counter element, a conical or frusto-conical roll or drum. In that case, the fibers are transported to the friction spinning disk and the yarn is formed on the friction spinning disk, cooperating with the conical or frusto-conical roll or drum, at a yarn formation position and is withdrawn therefrom by yarn withdrawal rollers. Such a device is illustrated and described, for instance, in British Patent Specification No. 1,231,198, published May 12, 1971.

Also, in place of a friction spinning drum or disk, it is possible to use an appropriately perforated band or belt (not shown) on which the fibers are delivered to a yarn formation position or location lying at substantially right angles to the direction of movement of the perforated band or belt, in order to thus produce a yarn.

Such a friction spinning apparatus equipped with the aforedescribed perforated band or belt, has been described and illustrated in French Patent No. 2,480,799, published Oct. 23, 1981.

Furthermore, in place of the suction device or unit 13, there can be used, a suitable mechanical take-up device (not shown). This mechanical take-up device merely must be capable of taking-up the twisted fiber structure 12 and the yarn 5 joined thereto at production speed and in the previously described manner.

Furthermore, it has bee found in practice, that an airstream or air flow of predeterminate intensity delivered by the pressure air infeed channel 8, the intensity being sufficient to grasp a twisted fiber structure 12 of predeterminate size and to forward it towards the yarn withdrawal rollers or roller pair 6, only becomes practically effective when the twisted fiber structure 12 has reached an adequate size and such size must be empirically determined.

From the foregoing explanations, it is possible to conclude that the airstream or air flow from the pressure air infeed channel 8 can be started simultaneously with or before the transport of the fibers 11 to the friction spinning drum 3.

Furthermore, it has been determined that the airstream or air flow has no negative influence or effect on the yarn produced or generated after the start spinning operation.

Accordingly, it is possible to appropriately select as desired, the sequence of operations as regards start-up of fiber transport and start-up of the airstream or air flow, or maintenance or switching-off of the airstream or air flow after the start spinning operation.

Advantageously, the sequence of operations is selected such that first the fibers 11 are delivered and the airstream or air flow is switched-on only after a twisted fiber structure 12 of desired or predeterminate size has been obtained.

Furthermore, switching-on of the airstream or air flow before delivery of fibers 11 can be used if required or desired, to clean the surface of the friction spinning drum 3 and the counter roller or drum 4. In accordance with the previous discussion, this cleaning airstream or air flow can be selectively maintained before delivery of the fibers 11 or switched-off before such fiber delivery.

In FIG. 2, the dot-dash line S indicates the central flowline of the airstream or air flow guided in the pressure air infeed channel or duct 8 and the angle $\alpha$ indicates that this flowline S lies at an inclination to the there shown yarn end 5.1 such that the dynamic or back-pressure arising from the aforesaid airstream or air flow thus generates a force component R directed towards the yarn withdrawal rollers or roller pair 6 and acting on the twisted fiber structure 12. The angle $\alpha$ is advantageously selected smaller than 45°.

In any event, it will be appreciated that the pressure air infeed channel or duct 8 possesses a flow direction for the airstream which flows therethrough which is directed such that the dynamic pressure arising from the flow of the airstream is dividable into two force components of different magnitudes defining a larger force component and a smaller force component. The larger force component, designated by reference character R, acts in the yarn withdrawal direction indicated by the arrow Z in FIG. 2.

Figure 8:
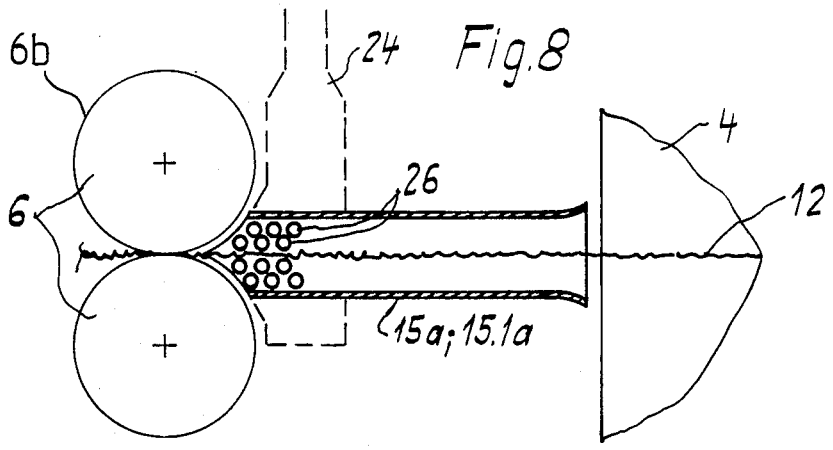
Figure 9:
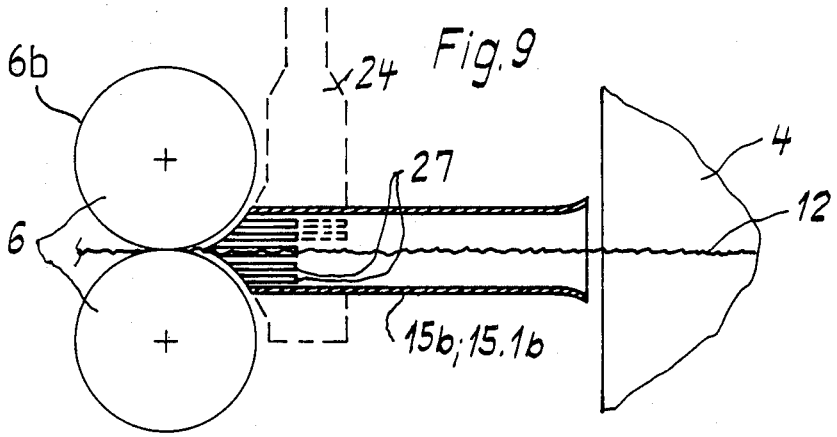

FIGS. 8 and 9 show exemplary embodiments of the inventive construction of the friction spinning apparatus in which the guide tube or tube member 15*a* or 15.1*a* (FIG. 8) or 15*b* or 15.1*b* (FIG. 9), as viewed in the yarn withdrawal direction Z, has venting openings 26 (FIG. 8) and 27 (FIG. 9), respectively, in those tube halves or regions directed towards the yarn withdrawal roller pair 6. These venting openings 26 or 27, as the case may be, enable substantial avoidance of the possibility that the main quantity of the air flowing in the guide tube or tube member 15*a* or 15.1*a* (FIG. 8) or 15*b* or 15.1*b* (FIG. 9) flows in the axial direction of the yarn withdrawal rollers or roller pair 6 in the convergent space of such yarn withdrawal roller pair 6. As a function of the necessary air quantity and the weight of the twisted fiber structure 12, such would have the disadvantage that the twisted fiber structure 12 would also be undesirably diverted by means of the air and would not be caught or seized by the yarn withdrawal roller pair 6.

This escape of the air through the respective venting openings 26 and 27 can be additionally augmented by a suction device 24 (indicated with dot-dash lines in FIGS. 8 and 9) provided at the region of these venting openings 26 and 27. This suction device 24 surrounds the related guide tube 15*a* or 15.1*a* (FIG. 8) or 15*b* or 15.1*b* (FIG. 9) such that the air is sucked away essentially evenly at the periphery of the related guide tube through the venting openings 26 and 27, as the case may be.

On the other hand, a graded or stepped suction effect can be advantageous in which case, for example, the perforation intensity or distribution increases in the yarn withdrawal direction Z. By virtue of this design, the air delivery can be increased without affording the twisted fiber structure 12 the opportunity to escape in the axial direction of the yarn withdrawal rollers or roller pair 6. The speed of the transporting air must, however, be selected such that the twisted fiber structure 12 does not remain caught on the internal wall of the associated guide tube or tube member.

In FIG. 8, the venting openings are provided in the form of bores or round apertures 26 or the like and in FIG. 9 in the form of slots or slits 27 or the like.

As previously mentioned, the guide tubes 15 and 15.1 depicted in FIGS. 1, 2, 4, 5, 6 and 7 can be provided with the venting openings 26 or 27, as the case may be. Consequently, it will be observed that there can be provided, the combination of the suction device 24 with the pressure air openings or ports 16 and 17 and the pressure housing 21 associated therewith. In order to distinguish these various possibilities of constructions, the guide tubes, it will be observed, and as noted previously, in FIG. 8, the guide tube or tube member is indicated by reference characters 15*a* and 15.1*a*, and in FIG. 9, by reference characters 15*b* and 15.1*b*.

The stepwise increase in the venting of the guide tube or tube member 15*b* or 15.1*b* (FIG. 9) can be, as indicated with the dotted or phantom lines, generated by lengthening the individual slots 27.

Figure 10:
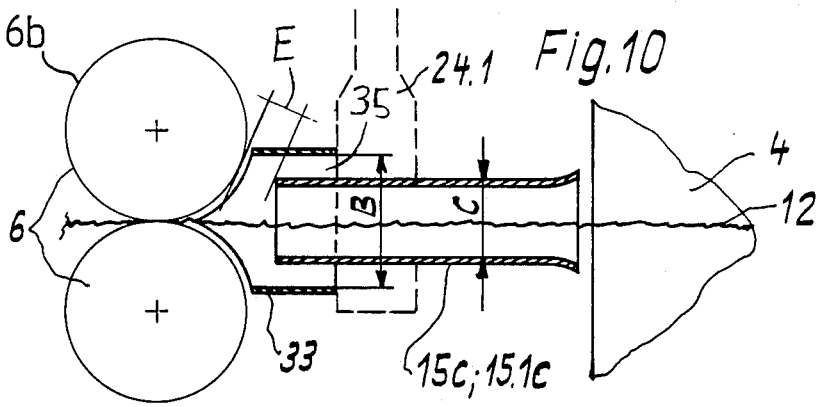

A further modification of the type of venting structure shown in FIGS. 8 and 9 is indicated in FIG. 10 in which in the region of the yarn withdrawal rollers or roller pair 6, the guide tubes 15 or 15.1, previously considered, are shortened and project into a venting tube or tube member 33 at a predeterminate spacing E from the yarn withdrawal roller pair 6. The shortened guide tubes or tube members have been indicated in FIG. 10 by reference characters 15*c* and 15.1*c*, respectively. The internal diameter B of the venting diameter C of the guide tube or tube member 15*c* or 15.1*c*, as the case may be, such that the air speed or velocity of the air in the venting tube or tube member 33 is exactly sufficient to forward the twisted fiber structure 12 onto the rotating peripheral surface of the yarn withdrawal rollers or roller pair 6 so that the twisted fiber structure 12 can pass into the clamping nip of the yarn withdrawal rollers or roller pair 6. Due to the difference between the internal diameter B and the external diameter C there is formed an annular or ring-shaped venting opening or gap 35. The spacing E is advantageously at least as large as the aforementioned difference between the dimensions B and C.

As indicated with dot-dash lines in FIG. 10, it is also possible to use the suction device 24, but here indicated by reference character 24.1 in FIG. 10, to draw away air flowing out between the guide tube or tube member 15*c* or 15.1*c* and the venting tube or tube member 33. This suction device 24.1 here surrounds the venting tube or tube member 33 and also the related guide tube or tube member 15*c* or 15.1*c* and, in view of this difference with respect to the suction device 24 of FIGS. 8 and 9, such suction device as above-noted, has been indicated with the reference numeral 24.1.

Figure 11:
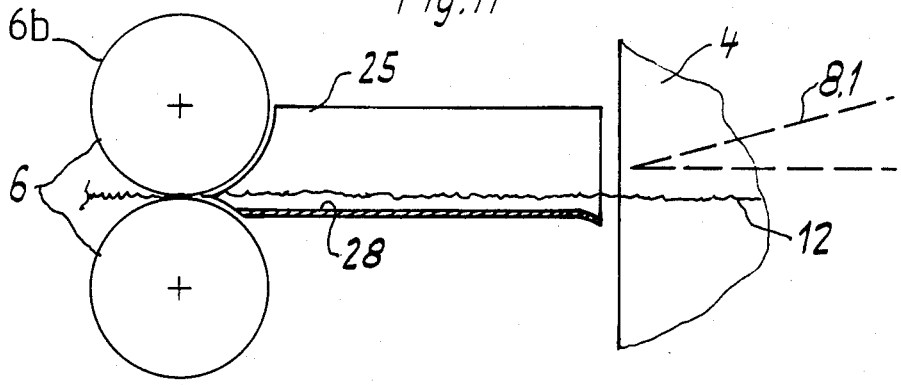

A further embodiment, which provides a modified function of the guide tube or tube member 15 is illustrated in FIG. 11 by the guide trough or trough member 25. As shown in FIG. 11, this guide trough or trough member 25 is closed-off downwardly and is open upwardly, and can have, for instance, either a substantially V-shape or substantially U-shape in section. Advantageously, the base 28 of the guide trough or trough member 25 is only slightly deeper than the stretched-out extended yarn guide line of the twisted fiber structure 12, as illustrated in FIG. 11.

Figure 12:
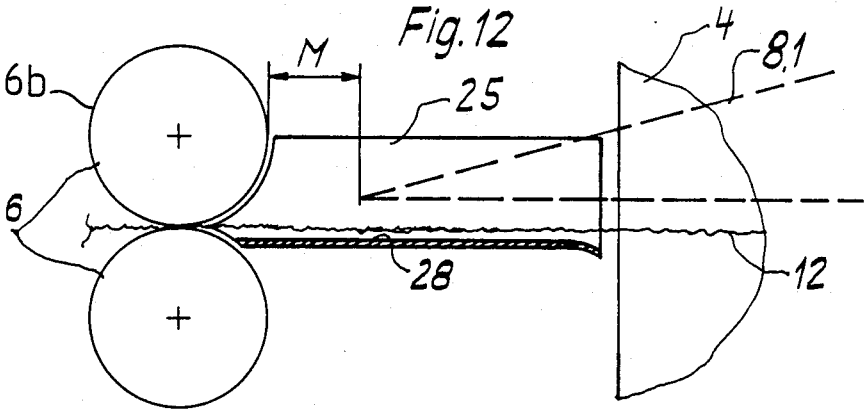
FIG. 12 illustrates a further exemplary embodiment of the inventive construction of the friction spinning apparatus of the arrangement of FIG. 1 in a view similar to the showing of FIG. 2 and in combination with the detail depicted in FIG. 11.

A further advantageous embodiment illustrated in FIG. 12 in combination with the guide trough or trough member 25 consists of an elongation of the pressure air infeed channel 8 in the direction of the yarn withdrawal rollers or roller pair 6 in the manner illustrated with dotted lines and indicated by reference numeral 8.1, so that the pressure air is not only directed towards the yarn formation position but also into the guide trough or trough member 25. On the other hand, as illustrated by the spacing M, the pressure air infeed channel 8.1 should only be extended to a given distance towards the yarn withdrawal rollers or roller pair 6 in order to afford the infed or blown-in air, the opportunity to escape in such a manner that the main air quantity can escape upwardly out of the guide trough or trough member 25 as viewed in FIG. 12.

Figure 13:
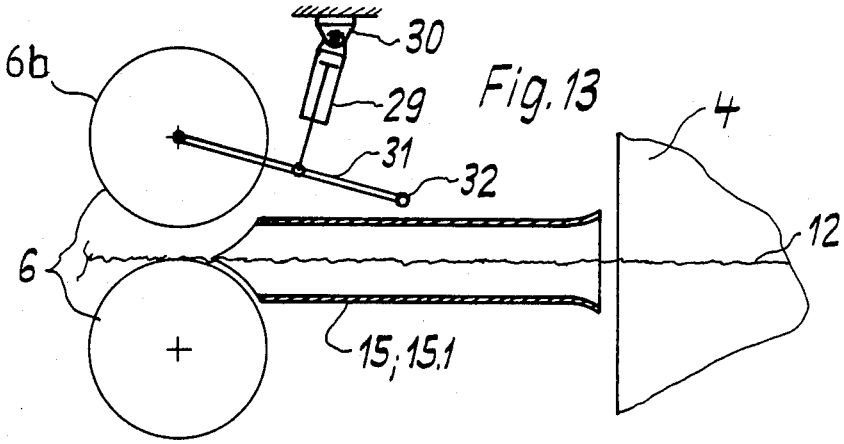
FIG. 13 illustrates a modification which is possible for the friction spinning apparatuses depicted in FIGS. 1 to 7.

FIG. 13 shows a possible modification for the arrangements of FIGS. 1 to 7 in that the upper yarn withdrawal roller or roll 6*b*, as viewed in the various FIGS. 1, 2, 4, 5, 6, 7, 8, 9 10, 11 and 12, is made raisable or elevatable. This upper roll raising action can be performed by any suitable type of conventional displacement or elevating means, for example, a fluid operated, such as a pneumatic cylinder or cylinder unit 29. The displacement or elevating means, here the pneumatic cylinder or cylinder unit 29, is connected by pivot or joint means, on the one hand, with a stationary housing portion 30 and, on the other hand, with a pivot lever 31 connected to the upper yarn withdrawal roll 6*b*. This pivot lever or lever member 31 is also pivotably mounted at its end 32 in a suitable stationary housing portion (not shown). Swinging-up or upward pivoting of the upper yarn withdrawal roller or roll 6*b* of the yarn withdrawal roller pair 6 is carried out only for a short time so that the twisted fiber structure 12 can be passed through. By means of this roll raising or lifting action, there is obtained the possibility that the air flowing through the guide tube or tube member, such as the guide tube 15 or 15.1, does not have to flow in the axial direction of the yarn withdrawal rollers or roller pair 6.

It will be clear that the lifting of the upper yarn withdrawal roller or roll 6*b* of the yarn withdrawal roller pair 6 illustrated in FIG. 13 also can be combined with the devices or structures of FIGS. 8 to 12.

A modification of the guide tubes or tube members 15, 15.1, 15*a*, 15.1*a*, 15*b*, 15.1*b*, 15*c* and 15.1*c* resides in forming the corresponding guide tube either along its complete length or in the front halves or regions, as viewed in the direction of forward travel of the yarn or yarn withdrawal direction Z, with a conical form or configuration, as simply representively indicated in FIG. 5 by reference character 15*d*, for thus reducing the tube section or cross-sectional area.

As can be seen from the various modifications, the inventive teachings and concepts are not limited to the illustrated examples and modifications thereof are readily possible.

Thus, while there are shown and described present preferred embodiments of the invention, it is to be distinctly understood that the invention is not limited thereto, but may be otherwise variously embodied and practiced within the scope of the following claims.

What we claim is:

1. A device for performing a start spinning operation entailing starting or recommencing spinning of a yarn in a friction spinning apparatus, wherein:

said friction spinning apparatus comprises:

friction spinning means provided with a friction spinning surface;

said friction spinning means defining a yarn formation position at which there is formed a twisted fiber structure;

means for delivering fibers to the friction spinning surface of the friction spinning means;

the fibers being formed into the twisted fiber structure at the yarn formation position during the start spinning operation;

yarn withdrawal means for withdrawing the twisted fiber structure in the form of a yarn in a yarn withdrawal direction;

said device for performing the start spinning operation comprising:

a pressure air infeed channel having an outflow opening directed towards the yarn formation position and through which flows an airstream;

said pressure air infeed channel possessing a flow direction for the airstream flowing therethrough which is directed such that dynamic pressure arising from the flow of the airstream is divisible into two force components of different magnitudes defining a larger force component and a smaller force component;

the larger force component acting in the yarn withdrawal direction of the yarn;

a yarn guide element provided between the friction spinning means and the yarn withdrawal means for guiding the twisted fiber structure and a portion of the airstream of the pressure air infeed channel;

said yarn guide element containing a portion directed towards said yarn withdrawal means;

air venting means provided in said yarn guide element in said portion directed towards said yarn withdrawal means; and said air venting means preventing the main quantity of the portion of the airstream flowing through said yarn guide element, from diverting the twisted fiber structure from said yarn withdrawal means.

2. The device as defined in claim 1, wherein:

said yarn withdrawal means comprises a yarn withdrawal roller pair.

3. The device as defined in claim 2, wherein:

said yarn guide element comprises a yarn guide tube.

4. The device as defined in claim 3, wherein:

said yarn guide tube includes a yarn guide tube portion directed towards said yarn withdrawal roller pair; and said air venting means constituting venting openings at said yarn guide tube portion which is directed towards said yarn withdrawal roller pair.

5. The device as defined in claim 4, wherein:

said venting openings are defined by bores; and said yarn guide tube opens in spaced relationship from and onto said yarn withdrawal roller pair and in close proximity thereto.

6. The device as defined in claim 5, wherein:

said yarn guide tube is structured in conformity to the curvature of the yarn withdrawal roller pair such that said yarn guide tube can be positioned in the immediate region of said yarn withdrawal roller pair.

7. The device as defined in claim 5, wherein:

said yarn guide tube is provided with air inflow means located in a portion thereof directed towards said friction spinning means and having an airflow directional component in the yarn withdrawal direction.

8. The device as defined in claim 4, wherein:

said venting openings are defined by venting slots;

said yarn guide tube opens in spaced relationship from and onto said yarn withdrawal roller pair and in close proximity thereto.

9. The device as defined in claim 8, wherein:

said yarn guide tube is structured in conformity to the curvature of the yarn withdrawal roller pair such that said yarn guide tube can be positioned in the immediate region of said yarn withdrawal roller pair.

10. The device as defined in claim 8, wherein:

said yarn guide tube is provided with air inflow means located in a portion thereof directed towards said friction spinning means had having an airflow directional component in the yarn withdrawal direction.

11. The device as defined in claim 3, wherein:

said yarn guide tube has an end portion situated adjacent said yarn withdrawal roller pair;

a venting tube constituting said air venting means and positioned to cooperate with said end portion of said yarn guide tube;

said venting tube surrounding the end portion of said yarn guide tube situated adjacent said yarn withdrawal roller pair;

said venting tube having an internal diameter;

said yarn guide tube having an external diameter;

the internal diameter of said venting tube being larger by a given value than the external diameter of the yarn guide tube to thus form an annular venting opening for said yarn guide tube;

said venting tube opening in spaced relationship from and onto said yarn withdrawal roller pair as in close proximity thereto; and said yarn guide tube projecting with a predetermined spacing toward said yarn withdrawal roller pair into said venting tube.

12. The device as defined in claim 11, wherein:

said yarn guide tube is structured in conformity to the curvature of the yarn withdrawal roller pair such that said yarn guide tube can be positioned in the immediate region of said yarn withdrawal roller pair.

13. The device as defined in claim 11, wherein:

said yarn guide tube is provided with air inflow means located in a portion thereof directed towards said friction spinning means and having an airflow directional component in the yarn withdrawal direction.

14. The device as defined in claim 3, wherein:

said yarn guide tube possesses a substantially conical configuration at least at a predeterminate region thereof in order to reduce the cross-sectional area of the yarn guide tube in the yarn withdrawal direction.

15. The device as defined in claim 2, wherein:

said yarn guide element comprises a guide trough defining an open side which constitutes said air venting means.

16. The device as defined in claim 15, wherein:

said pressure air inflow channel extends into the region of said yarn guide trough.

17. The device as defined in claim 2, further including:

means for opening said yarn withdrawal roller pair for the start spinning operation.

18. A device for performing a start spinning operation entailing starting or recommencing spinning of a yarn in a friction spinning apparatus, wherein:

said friction spinning apparatus comprises:

friction spinning drums provided with a friction spinning surface;

said friction spinning drums defining substantially between and along the friction spinning drums a yarn formation position at which there is formed a twisted fiber structure;

means for delivering fibers to the friction spinning surface of the friction spinning means;

the fibers being formed into the twisted fiber structure at the yarn formation position during the start spinning operation;

a yarn withdrawal roller pair for withdrawing the twisted fiber structure in the form of a yarn in a yarn withdrawal direction;

said device for performing the start spinning operation comprising:

a pressure air infeed channel having an outflow opening directed towards the yarn formation position and through which flows an airstream;

said pressure air infeed channel possessing a flow direction for the airstream flowing therethrough which is directed such that dynamic pressure arising from the flow of the airstream is divisible into two force components of different magnitudes defining a larger force component and a smaller force component;

the larger force component acting in the yarn withdrawal direction of the yarn;

a yarn guide tube provided between the friction spinning drums and the yarn withdrawal roller pair for guiding the twisted fiber structure and a portion of the airstream of the pressure air infeed channel;

said yarn guide tube includes a yarn guide tube portion directed towards said yarn withdrawal roller pair; and said yarn guide tube being provided with venting openings at said yarn guide tube portion which is directed towards said yarn withdrawal roller pair.

* * * * *

UNITED STATES PATENT AND TRADEMARK OFFICE

CERTIFICATE OF CORRECTION

PATENT NO. : 4,856,269

DATED : August 15, 1989

INVENTOR(S) : EMIL BRINER et al

It is certified that error appears in the above-identified patent and that said Letters Patent is hereby corrected as shown below:

Column 2, line 1, after "yarn" please insert --during the time required for the joining or connection--

Column 2, line 50, after "present" please insert --invention aims at the provision of an improved device for--

Column 4, line 34, after "a" replace "pacing" with --spacing--

Column 5, line 38, after "the" please insert --spinning operation, as well as also piecing-up after a yarn or--

Column 6, line 21, after "spinning" please insert --drum 3 at which the twisted fiber structure 12 and the--

Column 9, line 29, after "venting" please insert --tube or tube member 33 is chosen with respect to the external--

Column 12, line 13, after "means" please delete "had" and insert --and--

Signed and Sealed this

Twenty-third Day of October, 1990

*Attest:*

HARRY F. MANBECK, JR.

*Attesting Officer*

*Commissioner of Patents and Trademarks*